US006981667B2

(12) United States Patent
Hunag

(10) Patent No.: US 6,981,667 B2
(45) Date of Patent: Jan. 3, 2006

(54) ELLIPTICAL ACETABULIFORM BLADE FOR SHREDDER

(75) Inventor: Simon Hunag, SanChung (TW)

(73) Assignee: Michilin Prosperity Co., Ltd., Taipei Hsien (TW)

( * ) Notice: Subject to any disclaimer, the term of this patent is extended or adjusted under 35 U.S.C. 154(b) by 57 days.

(21) Appl. No.: 10/682,198

(22) Filed: Oct. 10, 2003

(65) Prior Publication Data

US 2005/0077407 A1 Apr. 14, 2005

(51) Int. Cl.
*B02C 18/16* (2006.01)

(52) U.S. Cl. ..... 241/295

(58) Field of Classification Search ..... 241/236, 241/293, 294, 295, 235
See application file for complete search history.

(56) References Cited

U.S. PATENT DOCUMENTS 5,199,666 A * 4/1993 Williams ..... 241/73
5,516,050 A * 5/1996 Yamamoto et al. ..... 241/167
6,454,196 B1 * 9/2002 Parke ..... 241/224

* cited by examiner

*Primary Examiner*—Mark Rosenbaum

(74) *Attorney, Agent, or Firm*—Dennison, Schultz, Dougherty & MacDonald

(57) ABSTRACT

The present invention relates to an elliptical acetabuliform blade for shredder, where a sheet metal is punched by a mold to integrally form an elliptical acetabuliform blade, where the periphery of elliptical blade is integrally formed into serration. The serrated periphery extending horizontally inwards to integrally form a planar disk for cutting paper along a longitudinal direction serves as a flank. The two ends along the major axis of the elliptical flank are each integrally formed into a hooked edge for cutting the paper along a longitudinal direction to form paper chips having double-tapering ends. These characteristics help to reduce the manufacturing cost, reduce the motor load and power consumption, to thereby enhance the market competitiveness.

3 Claims, 5 Drawing Sheets

ELLIPTICAL ACETABULIFORM BLADE FOR SHREDDER

FIELD OF THE INVENTION

The present invention relates to an improved cutting blade for a shredder, especially to an elliptical acetabuliform blade that is integrally formed by punching a sheet metal in a mold machine.

BACKGROUND OF THE INVENTION

The conventional shredders for cutting paper use a plurality of cutting blades and spacers engaging over a rotary cutter shaft, and the shearing force that two parallel and opposite rotary cutter shafts produce for transferring and cutting the paper-to-be-cut along a longitudinal direction into strips. Shredders can be classed into two types, the stripe-cut shredders and crosscut shredders, according to the machine cutting style. The former shredders arrange cutting blades to the rotating cutter shafts in a manner to cutting the paper in a longitudinal direction to form strips. The later shredders include blades that include more than one cutting edge, and each cutter is disposed helically along the rotary cutter shaft for first cutting paper along a longitudinal direction into strips and then cutting paper along a horizontal direction into approximate 4 mm×40 mm paper chips.

By referring to the assembled perspective view of a conventional blade illustrated in FIG. 1 and a planar view showing the operation of the conventional blade in FIG. 2, the conventional blade is made by punching a sheet metal having a thickness of approximately 2 mm into a circular blade by a mold. The blade includes a polygonal central hole A1 through which a rotary shaft may pass. The blade also includes cutting edges A2 that are spaced in 120 degrees apart around the periphery. As shown, when two blades are arranged on the rotary shafts B in a back-to-back manner to combine into a set of blades A, the cutting edges of the two blades assume a V-like edge A3. The opposite rotary shafts B' space the two blades apart by spacer (not shown) in a face-to-face manner to form a set of blade A'. When the paper-to-be-cut passes through the two reverse rotary shafts B, B', the opposing rotation of the periphery of the blades, that is, flanks A4 and flanks A4, will cut the paper like scissors. The opposing rotation of cutting edges A2 and the opposite flanks A4 will then cut the paper along a horizontal direction into 4 mm×40 mm paper chips.

During operating of the conventional blades, to ensure smooth cutting of the paper along the horizontal direction, sharp blades with proper orientations are needed. However, because the blades are formed by a punch molding, the mold wear that increases with the time will reduce sharpness of the blade edges, which does not improve until replacing the mold, to result in inconsistent quality. To ensure quality of the blades, it is necessary to shorten the service term of the mold, which results in increment of the cost. In addition, in the conventional blades, the thickness of the blade is the same as the width of the paper-to-be-cut. To ensure the strength of blades while cutting along the horizontal direction, the blades cannot be too thin, or else the blades tend to deform or fracture. Such a limitation attributes to the high material cost, which is less competitive as compared to the current market price. In addition, because the thickness of the conventional blades is same as the width of the paper-to-be-cut, and because the location of the width define the horizontal cutting points, the narrower width of cross-section is, the smaller output power is needed to cut along the horizontal direction. In other words, the motor can supply a minimum power for cutting along the horizontal direction, that is, to reduce the power consumed by the motor. But because of the width of the paper-to-be-cut by the conventional blades is 4 mm, the motor needs to output higher power to drive the blades and flanks moving in opposing directions to cut the paper along the horizontal direction smoothly.

SUMMARY OF THE INVENTION

In view of the above, this invention overcomes the shortcoming of the conventional blades.

The main objective of the present invention is to provide an elliptical acetebuliform blade for shredders, that is integrally punched from a sheet metal in a mold into an elliptical acetabuliform blade to effectively reduce the material cost and the weigh of the blade to thereby reduce the motor loading and power consumption.

Another objective of the present invention is to provide an elliptical acetabuliform blade for shredders, that uses the change in the curvature of the elliptical acetabuliform blade to cut paper into paper chips each having a wider center and tapering towards the ends, so as to reduce the power that that motor needs to output for cutting the two ends to thereby reduce the motor loading and the power consumption.

To realize the above objectives, in the present invention, a sheet metal is punched by a mold to integrally form an elliptical acetabuliform blade, where the periphery of elliptical blade is integrally formed into serration. The serrated periphery extending horizontally inwards to integrally form a planar disk for cutting paper along a longitudinal direction serves as a flank. The two ends along the major axis of the elliptical of the flank are integrally formed into a hooked edge for cutting the paper along a longitudinal direction to form paper chips having double-tapering ends. An inner edge of the flank then integrally extends inwards and downwards to form an arc base and then a circular base. A polygonal hole is formed in a center of the circular base, through which a rotary shaft may pass.

DESCRIPTION OF THE PREFERRED EMBODIMENT

The present invention will be described in further detail hereinafter, with reference to accompanying drawings.

Figure 2:
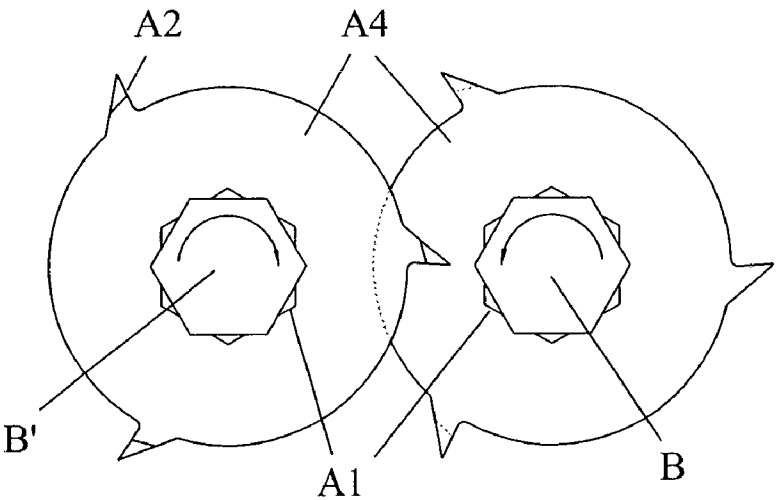
Fig. 2 Prior Art
FIG. 2 is a planar view of a conventional shredder in operation.
Figure 1:
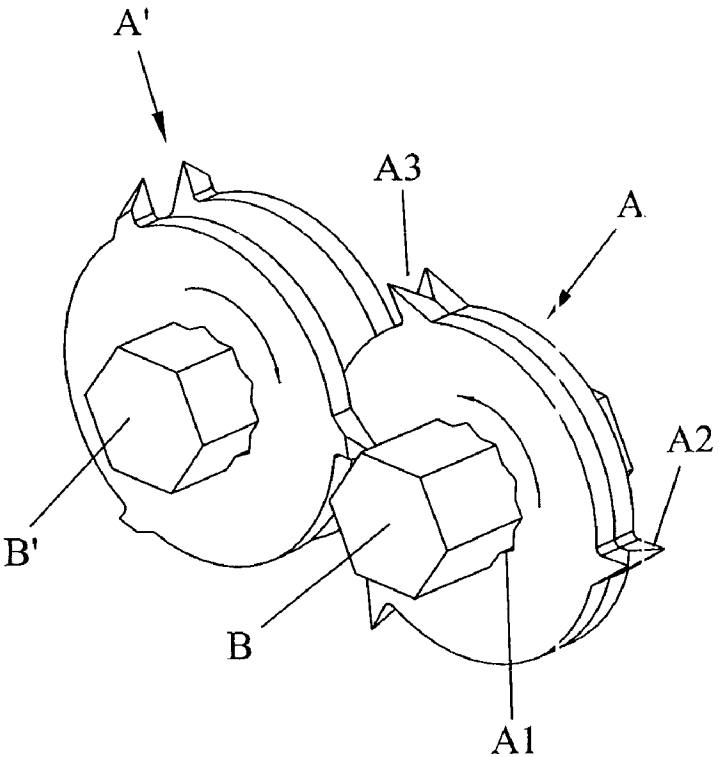
Fig. 1 Prior Art
FIG. 1 is an assembled perspective of a conventional shredder.
Figure 3:
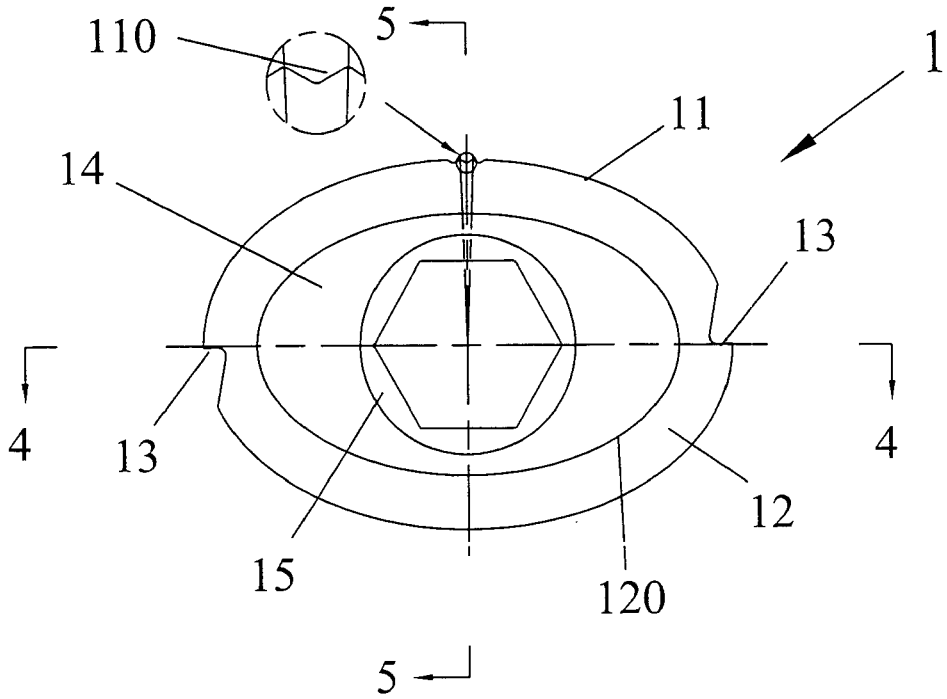
FIG. 3 is the a planar view of the elliptical acetabuliform blade of the present invention.
Figure 4:
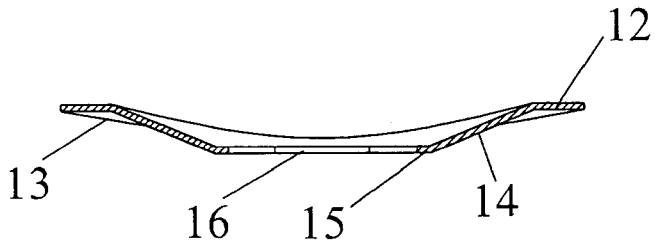
FIG. 4 is a cross-sectional view taken along lines 4—4 in FIG. 3.
Figure 5:
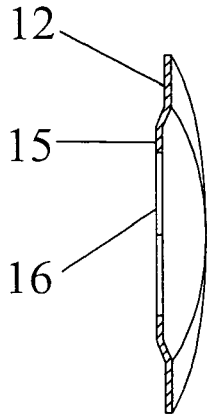
FIG. 5 is a cross-sectional view taken along lines 5—5 in FIG. 3.

Please refer to FIGS. 3 to 5, where FIG. 3 illustrates the planar view of the present invention, and FIGS. 4 and 5 are cross-sectional views taken from lines 4—4 and line 5—5 in FIG. 3, respectively. The above-mentioned views disclose a revolutionized cutting blade 1 for a shredder, which blade is able to provide an optimum sheet capacity based on the various types of shredders. The present invention selects a sheet metal having a thickness of 0.2 mm as a raw material, the selected sheet metal is punched into an elliptical acetabuliform blade by a mold. The periphery 11 (shown in the enlarged view of FIG. 3) of the elliptical blade is integrally formed into serration 110. The periphery 11 of serration serves to pull the paper-to-be-cut downwards. The acetabuliform periphery 11 extending horizontally inwards to integrally form a planar disk for cutting paper along a longitudinal direction serves as a flank 12. The two ends along the major axis of the elliptical flank 12 are each integrally formed into a hooked edge 13 for cutting the paper along a longitudinal direction to form paper chips having double-tapering ends. An inner edge 120 of the flank 12 integrally extends inwards and downwards to form an arc base 14 and then a circular base 15. A polygonal hole 16 is formed in a center of the circular base 15, through which a rotary shaft may pass.

Figure 6:
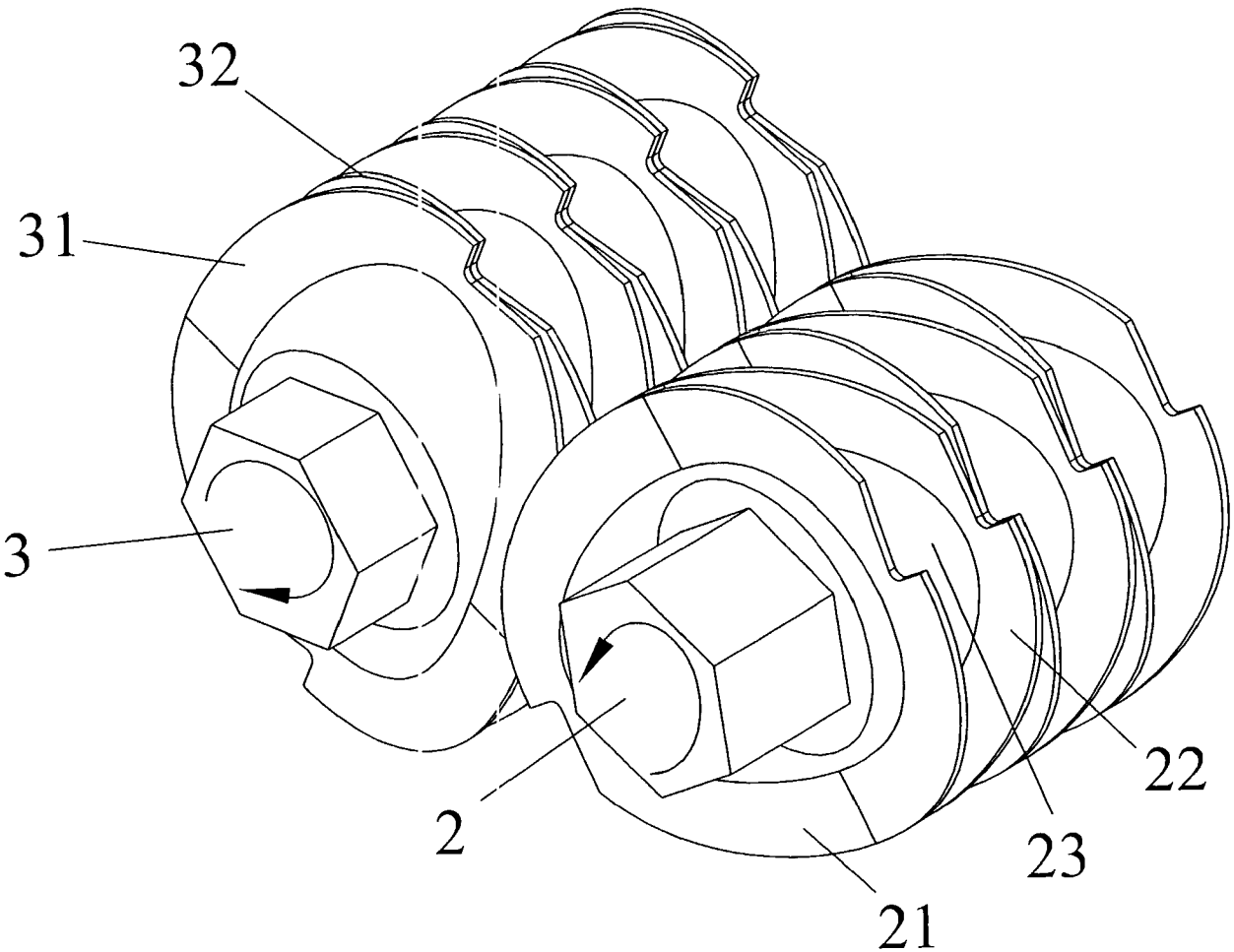
FIG. 6 is a perspective view of the elliptical acetabuliform blade assembled to the rotary shafts.

As shown in the assembled perspective view of the present invention in FIG. 6, the standardized elliptical acetabuliform blades punched from a sheet metal by a mold are arranged sequentially on two rotary shafts to be assembled into the rotary cutting tool that is most important for a shredder. During assembly, the elliptical acetabuliform blades on one of the rotary shafts are arranged by alternating in forward and reversed orientations. The elliptical acetabuliform blades on the other rotary shaft are then arranged by alternating in reversed and forwards orientations.

As exemplified in FIG. 6, the first blade 21 and the second blade 22 on a lower first rotary shaft 2 are arranged by alternating in the forward and reversed orientations. Because the blades extend from an inner periphery of flank inwards and downwards to form an arc base and then a circular base, the circular base of the first blade 21 and second blade 22 join to contact each other while the hooked edges of the first blade 21 and the second blade 22 are separated from each other to assume an open space 23. On the other hand, the first blade 31 and second blade 32 on an upper second rotary shaft 3 are arranged by alternating in the forward and inversed orientations. Similarly, because the blades extend from the inner periphery of the flanks inwards and downwards to form an arc base and then a circular base, the circular base of the first blade 31 and second blade 32 are separated from each other, while the hooked edges of the first blade 31 and the second blade 322 are joined to contact each other. By adopting such arrangement, when the two rotary shafts rotate in opposing directions, the hooked edges 33 of the first blade 31 and the second blade 32 on the upper second rotary shaft 3 after contacting each other adapt to insert into the open space 23 of the first blade 21 and second blade 22 on the lower first rotary shaft 2.

Figure 7:
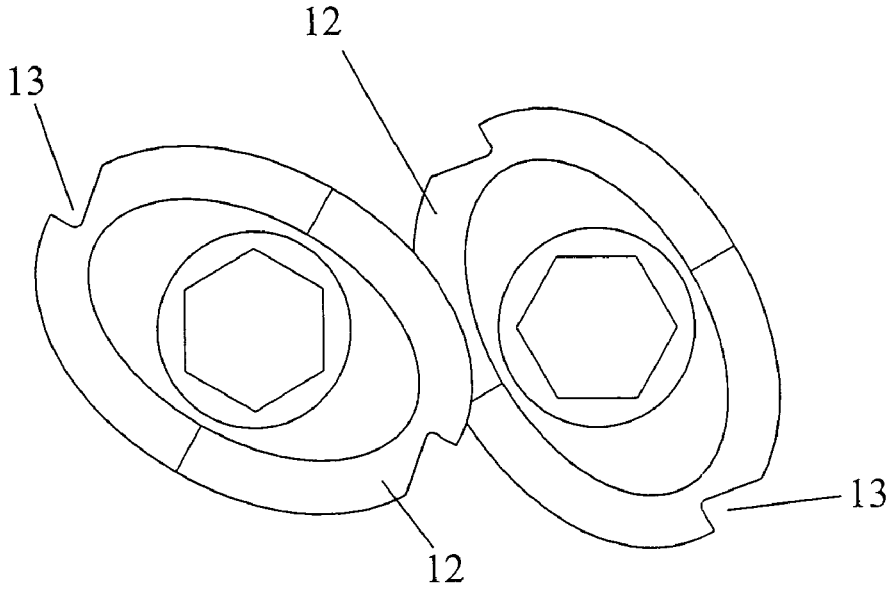
FIG. 7 is an operating view of the elliptical acetabuliform blade of the present invention in cutting paper.
Figure 8:
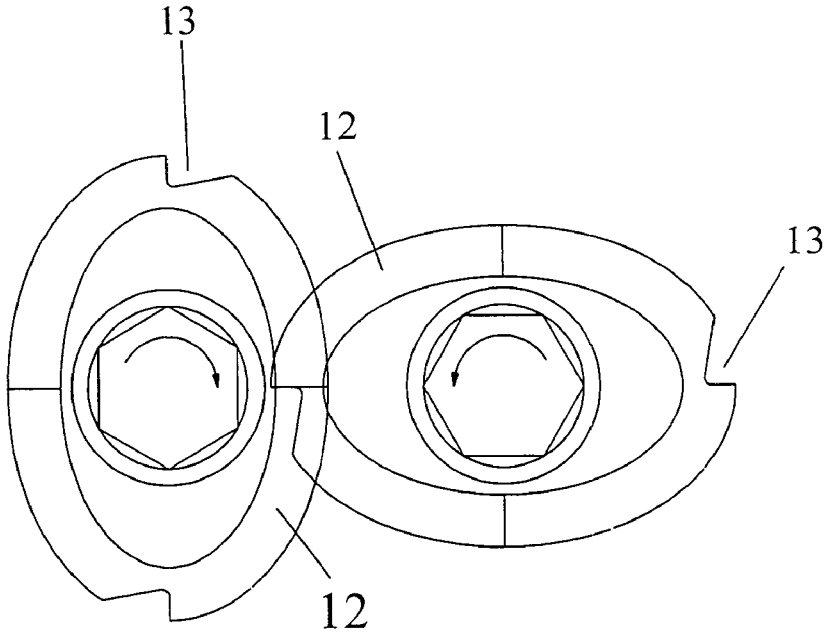
FIG. 8 is an operating view of the elliptical acetabuliform blade of the present invention in cutting off paper.

As shown in the operating views in FIGS. 7 and 8, the standardized elliptical acetabuliform blades enable the flanks of the corresponding blade set to maintain a certain contact gap at all time by means of the changes between the major axis and minor axis of the elliptical blades and the curvatures of the blades. In other words, while viewing from the rear projection, the superposition of the blades arranged on different rotary shafts are constant. Such a constant superposition can ensure scissors like cutting effects between the flanks 12 when the two rotary shafts rotate in opposing directions (shown in FIG. 7). When the cutting edges 13 of the corresponding opposite blades on the two ends of elliptical major axis rotate to the elliptical major axis, the hooked edges 13 on the major axis of the elliptical blades will cooperate with the flanks 12 on the minor axis of the mating elliptical blades to cut off the paper strips (as shown in FIG. 8).

Figure 9:
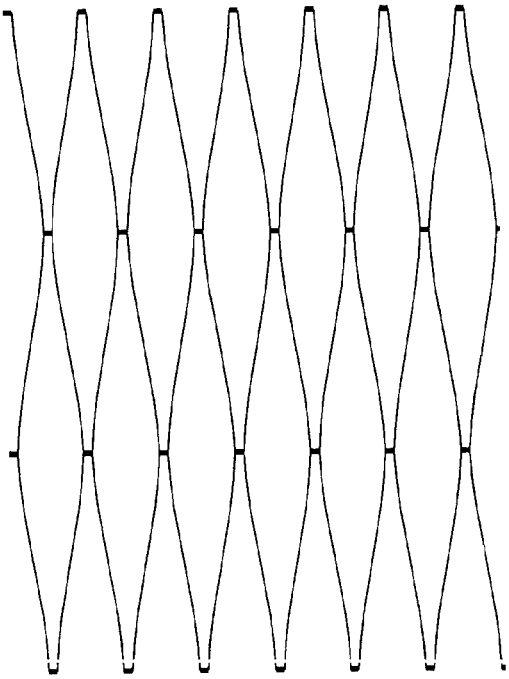
FIG. 9 is a schematic view of the elliptical acetabuliform blade of the present invention fragmenting paper after cutting.
Figure 10:
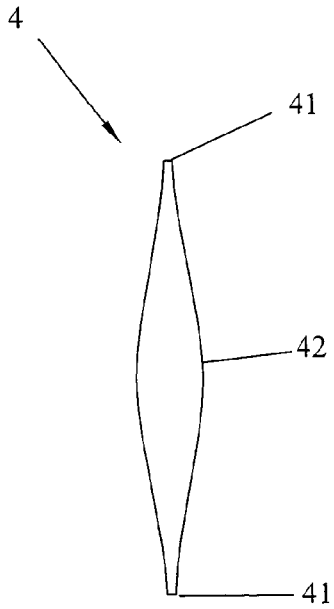
FIG. 10 is a schematic view showing the paper after being cut by the elliptical acetabuliform blade of the present invention.

FIGS. 9 and 10 illustrate the schematic views of the elliptical acetabuliform blade of the present invention fragmenting paper after cutting, and the paper after being cut by the elliptical acetabuliform blade of the present invention. Along with the changing of the curvatures of the elliptical acetabuliform blades, the paper is fragmented into paper chips 4 each having a wider center 42 and tapering towards the ends 41. Because of the two ends 41 of the paper chip 4 are the horizontal cutting positions, the narrower width of cross-section is, the smaller output power is needed to cut along the horizontal direction. In other words, the motor can supply a minimum power for cutting along the horizontal direction under a minimum load. The reduction in the motor load also reduces the power consumption and increases service-life of the motor.

In addition, the conventional blade is punched from a sheet metal having thickness of about 2 mm, while the elliptical acetabuliform blade of the present invention may be punched from a sheet metal having a minimum thickness of 0.2 mm, where the costs of the two materials are significantly different, and the reduced weight also helps to further reduce the power that the motor needs to supply to thereby increase the service-life of the motor and reduce the power consumption. These characteristics help to reduce the manufacturing cost and enhance the market competitiveness.

In summary, according to the present invention, a sheet metal may be punched into elliptical acetabuliform blades, where the periphery of each elliptical blade is integrally made into serration. The serrated periphery extending horizontally inwards to integrally form a planar disk for cutting paper along a longitudinal direction serves as a flank. The two ends along the major axis of the elliptical flank are each integrally formed into a hooked edge for cutting the paper along a longitudinal direction to form paper chips having double-tapering ends. The revolutionized construction of the present invention reduces power consumption, material cost, and lessens motor load, so as to enhance the market competitiveness of the shredder.

In the present specification "comprises means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

| LISTING OF NOMENCLATURES | |
|---|---|
| 1 cutting blade | 11 periphery |
| 110 serration | 12 flank |
| 13 cutting edge | 14 base |
| 15 base | 16 polygonal hole |
| 2 first rotary shaft | 21 first blade |
| 22 second blade | 23 open space |
| 3 second rotary shaft | 31 first blade |
| 32 second blade | 33 hooked edges |
| 4 paper chips | |

What is claimed is:

1. An elliptical acetabuliform blade for a shredder, punched from a sheet metal in a mold into an elliptical acetabuliform blade, wherein a periphery of elliptical blade is integrally formed into a planar disk serving as a flank, two ends along the major axis of the elliptical flank are integrally formed into a hooked edge, an inner edge of the flank then integrally extends inwards and downwards to form an arc base and then a circular base.

2. An elliptical acetabuliform blade for a shredder according to claim 1, wherein, the periphery of elliptical blade is integrally formed into a toothed edge.

3. An elliptical acetabuliform blade for a shredder according to claim 1, wherein the center of the base is provided with a polygonal hole.

* * * * *